United States Patent [19]

Nickell et al.

[11] 4,069,030

[45] Jan. 17, 1978

[54] ENERGY CONSERVATION ENTHALPY CONTROL SYSTEM AND SENSOR THEREFOR

[75] Inventors: Grason T. Nickell; Jack L. Alexander, Sr., both of Greensboro, N.C.

[73] Assignee: Air Conditioning Corporation, Greensboro, N.C.

[21] Appl. No.: 716,231

[22] Filed: Aug. 20, 1976

[51] Int. Cl.[2] ..... F25D 17/04

[52] U.S. Cl. ..... 62/176 C; 73/343 B; 165/16

[58] Field of Search ..... 73/336.5, 338, 343, 73/338.6; 165/16; 236/49; 62/176 C, 176 R, 179, 186, 409

[56] References Cited

U.S. PATENT DOCUMENTS

| | | | |
|---|---|---|---|
| 2,268,442 | 12/1941 | Crawford | 73/338.6 |
| 2,302,528 | 11/1942 | Conklin | 73/338.6 |
| 2,392,553 | 1/1946 | Rollins | 62/176 C |
| 3,153,332 | 10/1964 | Goettl et al. | 62/176 C |
| 3,927,713 | 12/1975 | Gilles | 165/16 |
| 3,979,922 | 9/1976 | Shavit | 165/16 |

*Primary Examiner*—William E. Wayner

*Assistant Examiner*—Robert J. Charvat

*Attorney, Agent, or Firm*—Lane, Aitken, Dunner & Ziems

[57] ABSTRACT

An energy conservation enthalpy control system utilizes a sensing unit for sensing the wet bulb temperature of sampled air, both outside air and return air, under conditions which approximate adiabatic saturation. The unit includes a housing adapted to pass filtered air through the unit. Water circulated throughout from a sump in the housing is intimately contacted and mixed with the air by a spray or an evaporative pad. A temperature sensing element located in the sump or in the airstream provides a signal indicating the wet bulb temperature of the air under adiabatic saturation conditions. The unit provides the inputs to a control system which operates to coordinate the operations of return air dampers, outside air dampers, and air conditioning equipment. When outside air reaches a wet bulb condition lower than the wet bulb condition of return air in the system, the control system operates to open or modulate the outside air dampers, close or modulate the return air dampers, and modulate or shutoff the chilled water in the system.

18 Claims, 6 Drawing Figures

ENERGY CONSERVATION ENTHALPY CONTROL SYSTEM AND SENSOR THEREFOR

BACKGROUND OF THE INVENTION

This invention relates to an enthalpy control system for conserving energy in an air conditioning system. More particularly, this invention relates to a self-contained sensing unit for measuring the wet bulb temperature of outside and return air under conditions which approximate adiabatic saturation and provide an output signal representing such wet bulb temperature for use in such a control system. Still more particularly, this invention relates to a control system for coordinately controlling return air dampers, outside air dampers and air conditioning components, including means for chilling water, to conserve energy based on the optimum mixture of return air, outside air, and chilling effects.

Special emphasis today is needed and is being placed on energy conservation. In any type of air conditioning system, it is less energy consuming to use outside or outdoor air whenever the enthalpy, or total heat, of the outdoor air is less than that of the air returning to the air conditioning system. While air conditioning systems sometimes have economizer cycles whereby the controls can automatically blend outside and return air for cooling during intermediate periods when the outdoor air is sufficiently cool, such systems, however, have utilized dry bulb measuring and control techniques. Moreover, historically, industrial heating and air conditioning systems have been switched from refrigeration or cooling to outside air control either manually or by an outdoor dry bulb thermostat. Manual operation is inefficient, attention-requiring, and often unrelated to the most energy conservative utilization of the system. On the other hand, any method of switching which relies on wet bulb sensing is apt to be inaccurate, approximate conditions of adiabatic saturation are deviated from, and also unrelated to the true total content of the outside and return air respectively.

The true measure of the enthalpy in air is obtained by observing the wet bulb temperature. Traditionally, in this industry, the wet bulb temperature is obtained by a conventional dry bulb thermostat having its sensing element surrounded by a wetted cloth or wick. This type of device has posed considerable maintenance problems inasmuch as the wick can be fouled by contaminants, including dirt, in the outdoor or return air. Moreover, the wick can become dry as a result of poor maintenance of the wetted wick and of a suitable air velocity. Thus, this type of instrument under those conditions began to operate like a mere dry bulb instrument and the benefit of enthalpy sensing no longer existed. Thus, in the industry, the aforementioned problems led to the adoption of conventional dry bulb changeover devices.

With the increased sensitivity to the need to conserve energy and in the face of rising power costs, it is a current problem in this art to produce a unitary, reasonably-priced enthalpy sensing device and an enthalpy-controlled control system using such a device to cause an air conditioning system to switch to outside air whenever the enthalpy of the outdoor air falls below the enthalpy of the air conditioned space. By the apparatus and control system of this invention, considerable operating energy of the refrigeration or air conditioning equipment can be saved.

For example, by reference to a psychometric chart, an assumed space design condition of 75° F. dry bulb, 50 per cent relative humidity, and a design supply air temperature of 55° F. dry bulb represents a wet bulb temperature of 62.3° or an enthalpy of approximately 28 BTU per pound of dry air. Under a reduced outside air load, it is thus possible to cool the space effectively by a supply air temperature of 58° F. or even higher, depending on the internal heat released from lights or other heat generating equipment in the space.

Accordingly, whenever the outdoor air enthalpy is lower than the return air enthalpy within the air conditioned space, it is more economical to cool 100 per cent outside air than to recirculate a mixture of outside air and room air. In addition, the use of increased proportions of outside air provides for a greater dilution of space odors and improved ventilation. As the enthalpy of the outdoor air reduces, greater savings in refrigeration power are thus achieved. At a predetermined point, the system can also be switched to a cycle whereby the outside and return air dampers are modulated to maintain the desired dry bulb temperature within the facility.

If an air washer system is utilized, even further savings can result to the consumer and less energy used as a result of the adiabatic saturation process which occurs in an air washer with no active refrigeration.

It is thus a principal object of this invention to provide a unitary, convenient, enthalpy sensing device for use in sensing both outdoor and return air in an air conditioning control system.

It is another object of this invention to provide a sensing device for sampled air which senses the wet bulb temperature of the air under conditions which approximate adiabatic saturation.

It is a general object of this invention to overcome the disadvantages of the traditional wick-type wet bulb instrument and to provide a unique and simple control scheme for the control of conventional comfort air conditioning systems as well as constant temperature and humidity systems utilizing air washers.

These and other objects of this invention will become apparent from a review of the following written description of the invention taken in conjunction with the accompanying drawings.

BRIEF SUMMARY OF THE INVENTION

Directed to achieving the aforestated objects and overcoming the problems and disadvantages of the prior art, the invention includes an enthalpy sensing device for sensing the true wet bulb temperature of sampled air passing through a housing under approximately adiabatic saturation conditions and providing a control signal indicative of the wet bulb temperature of the sampled air. A rectangular housing includes sampled air passageways preferably in the opposed ends thereof, at least the input air opening including a filter for removing physical contaminants, including dirt, from the air. A motor-operated fan for drawing air through the housing is provided in the opposed air opening. The base of the housing includes a sump for collecting and retaining water.

Mixing means are provided in the housing for intimately mixing and contacting the water from the sump in the housing and the air passing through the housing. A pump causes water from the sump to exit in a spray through a nozzle member to mix either directly with the air or to pass onto an evaporative pad arranged to pass the air therethrough.

A sensing element including a temperature sensing member is located in the water or in the air with a capillary in circuit with a signal transmitter. Where an air actuated control system is used, the signal transmitter converts wet bulb temperature signals to air pressure signals, but other electrical, hydraulic, or mechanical systems could be used.

The control system according to the invention uses the output signal from a pair of the above-described sensing units, one representing outside air enthalpy, the other representing return air enthalpy. The signals are compared and the compared signal output is utilized to allow the system thermostat to control the chilled water valve and an air damper control motor. A normal system controller such as a thermostat is provided also to control the chilled water valve. In its preferred embodiment, a pneumatic system control scheme is used where the signal comparator is a differential pressure switch for receiving pressure signals representing the enthalpy of the outside air and the return air. The pressure switch is in circuit with a main power source for switching an air solenoid valve.

When the outside air enthalpy is lower than the return air enthalpy, the control system operates to close or modulate the return air dampers, open or modulate the outside air dampers, and control the chilling effects of the air conditioning system. The control system may be used for both air washer systems or comfort air conditioning systems.

DETAILED DESCRIPTION OF THE PREFERRED EMBODIMENT

Figure 1:
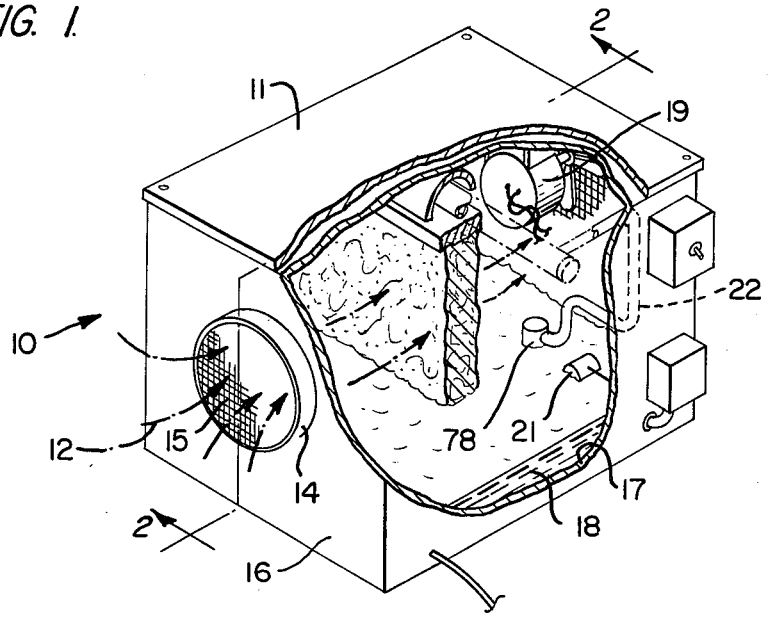
FIG. 1 is a partially cut away perspective view of the enthalpy sensing unit according to the invention.

The enthalpy sensing unit, according to the invention, is shown in detail in FIGS. 1-4 and is designated generally by the reference numeral 10. The unit 10 includes an elongated rectangular unitary housing 11 adapted to pass air through the housing in the direction designated by the inlet air arrows 12 and the outlet air arrow 13. An inlet air opening 14 houses a filter element 15 in the inlet face 16 of the housing 11. The filter is sized to remove physical contaminants, including dirt, from the inlet air to the unit. At its lower position, the housing defines a sump 17 for collecting and storing a quantity of water 18. A fan and motor assembly 19 are located in the opposed face of the unit 11 for drawing the sampled air therethrough.

Means, designated generally by the reference numeral 20, are provided for intimately contacting and mixing water from the sump 17 with the sampled air passing within the housing 11. The mixing means 20 include a combination float 21 and pump 78 and fluid conduit 22 for pumping water from the sump 17 through the conduit 22 to a spray member 23, for example, a pipe having a plurality of openings 24 disposed in an array on its arcuate surface for substantially its entire length of about the width of the housing 11. The float operates to replenish the water supply in the sump 17 from an outside source (not shown) so that the unit automatically maintains a predetermined water level in the sump. An arcuate shield 26 is spacedly located above the spray member 23 to confine and distribute the water spray from the pipe. The float acts to shut off the make up water when the water 18 in the sump 17 is above a predetermined low level.

Figure 2:
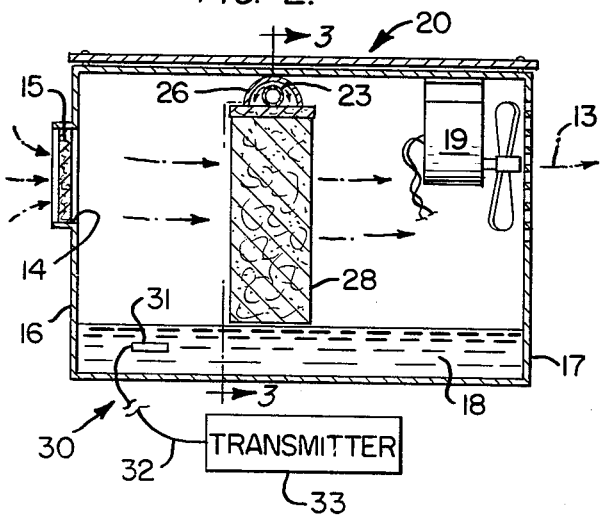
FIG. 2 is a cross-sectional view taken along line 2—2 of the unit of FIG. 1 in combination with an enthalpy signal transmitter.
Figure 3:
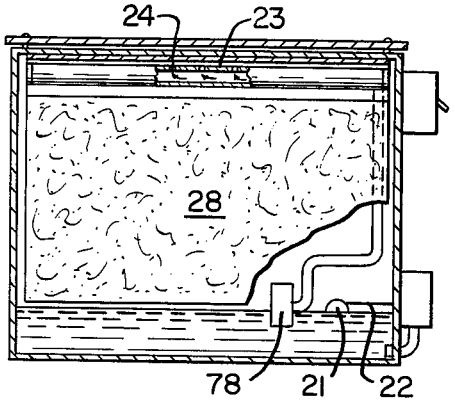
FIG. 3 is a side cross-sectional view taken along line 3—3 of FIG. 2 showing an embodiment illustrating the mixing means which includes a spray member spraying water on an evaporative pad.

In the preferred embodiment of FIG. 2, the water spray is directed by the shield 26 upon an evaporative pad 28. Evaporative or humidifier pads are commercially available, for example, from The Munters Corporation (for example, under the trademarks "HUMI-KOOL CELDEK" and "ASBESDIK"). Such pads are made from a cellulose paper impregnated with insoluable anti-rot salts, rigidifying saturants and wetting agents and arranged in a cross-fluted configuration which allows for air flow therethrough and water flow thereon without clogging. Such pads are geometrically structured to provide a large evaporative surface per cubic unit of material and to induce a highly turbulent mixing between the water and the air for heat and moisture transfer between them.

Figure 4:
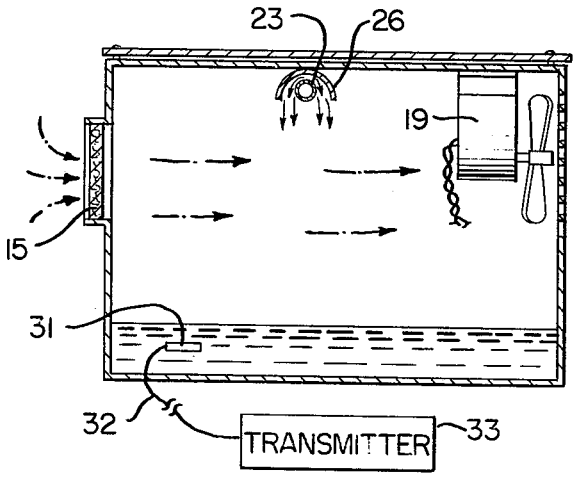
FIG. 4 is a side cross-sectional view of an alternative embodiment of the mixing means of FIG. 2 showing only a spray member.

In FIG. 4, an alternative embodiment is shown in which the evaporative pads are eliminated while retaining spray means for particulating and dispersing water to mix with and contact the air. The spray means 23 produces a finely distributed spray intended to achieve adiabatic saturation of the air and to achieve quickly thermal equilibrium between the water and the air.

A sensing element designated generally by reference numeral 30 includes a sensing bulb 31 preferably located in the water 18 in the sump 17. The bulb 31 is connected to a capillary 32 which is in circuit with a signal transmitter 33. The signal transmitter 33 transmits a signal indicative of the wet bulb temperature of the sampled air passing through the unit 11. Where the control system is a pneumatic transmission system, the temperature transmitter 33 converts the temperature measurement to an air pressure signal. Such transmitters are commercially available from such suppliers as Johnson Service Company or Powers Control Company. For completeness of disclosure, a suitable transmitter 33 is designated by Model No. T-5210 from the former supplier.

The unit 11 thus provides an output accurately representing the wet bulb temperature of the air after the air and water are in thermal equilibrium. Since an ideal adiabatic saturation process adds no sensible heat to the air or water, the enthalpy sensed by the unit 11 closely approximates these conditions. Slight deviations from the ideal caused by the energy input to the pump which in turn may cause a slight temperature rise in the water are substantially constant and can be suitably compensated for in the calibration and setting of the system thermostat.

Figure 5:
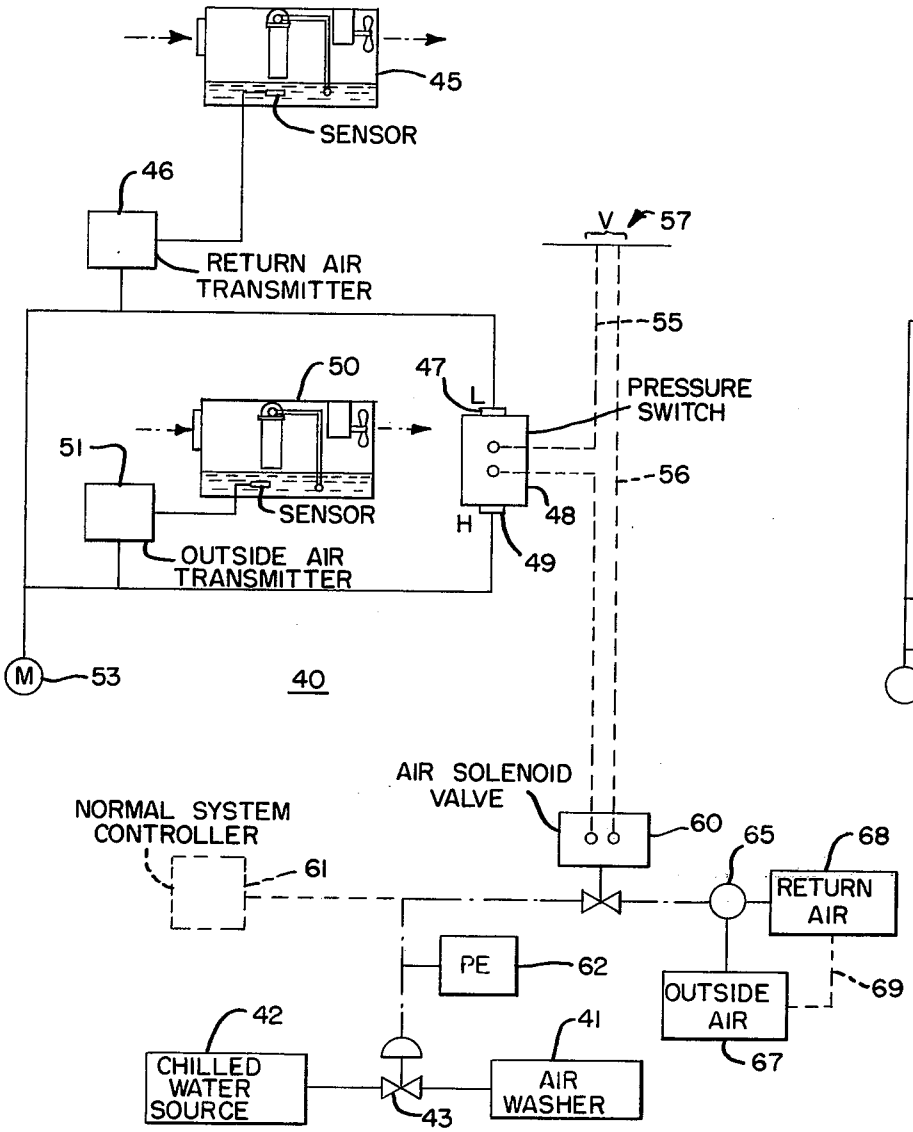
FIG. 5 is a block control diagram of a control system using the units of FIG. 1 as both outside and return air enthalpy sensors for an air washer.

FIG. 5 shows a control system, designated generally by the reference numeral 40 applicable to an air washer system 41 utilizing chilled water from a central chilled water source 42. The details of the air washer system 41 and its components vary among installations and are not necessary for an understanding of the invention. Such systems generally include a recirculation pump which continuously recirculates water from the sump of the washer to the sprays in the washer. A chilled water valve 43 is used to admit chilled water to the intake of the recirculation pump of the air washer system 41 in order to permit chilled water to be sprayed into the washer when cooling or dehumidification is necessary. The air washer system 41 may include a plurality of washers with water returning to a central sump with central refrigeration which can be turned on or off by an operator or by chilled water demand.

The control system 40 includes a return air sensor 45 (preferably as described in connection with FIGS. 1–4) which provides a return air enthalpy signal to the return air transmitter 46 having an output connected pneumatically to the low pressure input terminal 47 of a differential pressure switch 48. Similarly, an outside air sensor 50 (preferably as described in connection with FIGS. 1–4) provides an outside air enthalpy signal to the outside air transmitter 51 having its output pneumatically connected to the high pressure terminal 49 of the differential pressure switch 48. A source 53 of air is connected to each of the transmitters 46 and 51 and provides main air preferably at about 20 pse.

The differential pressure switch 48 is in circuit with one conductor 55 of a main power source 57 having a second conductor 56. The conductors 55 and 56 are connected to an air solenoid valve 60 operative in response to a direct acting normal system controller 61, or system thermostat. As temperature increases, for the pneumatic system shown, the output pressure of the controller 61 increases.

A pneumatic electric switch 62 designed in this specific embodiment to open at a predetermined pressure, for example, at about 8.5 psig, is in circuit with the chilled water valve 43. The chilled water valve is open in the control range of 9–13 psig and the opening of the valve in this range may be modulated. The pneumatic switch 62 causes an electrical signal therefrom to turn off the chilled water refrigeration equipment.

An air motor 65 is connected to the air solenoid valve 60 and operates to control the normally closed outside air dampers 67 and the normally open return air dampers 68. Preferably, the dampers 67 and 68 operate coordinatedly, as represented by the dotted line 69, so that when the damper 67 is open, damper 68 is closed and vice versa. The positions of the dampers 67 and 68 can be modulated to points intermediate full open and full closed.

The system of FIG. 5 operates as follows. Whenever the outside air transmitter 51 transmits a pressure lower than the return air transmitter 46 (representing lower enthalpy in the outside air), the differential pressure switch 58 is activated and the air solenoid valve 60 is opened. The opening of the solenoid valve 60 permits the normal system controller (thermostat) 61 to continue to operate the chilled water valve 43 with the outside air dampers 67 in as much as a full open position. Since the normal system controller 61 is a direct acting thermostat, its branch pressure increases with an increase in the temperature at the location of the thermostat. Under this mode of operation, the switching, when the outside enthalpy drops below the return enthalpy, occurs when the system is calling for some chilled water and the branch pressure is in the 9–13 psig range. Under these circumstances, the normally closed outside air damper 67 would be fully open at about 8 psig.

As the outside air wet bulb temperature, and its enthalpy, decreases, the amount of chilled water required decreases and stops completely when the normally closed chilled water valve 43 reaches about 9 psig. The pneumatic electric instrument 62 is thus set at 8.5 psig to turn off the refrigeration when the branch pressure drops below that value.

A further drop in the outside wet bulb temperature permits the normal system controller thermostat 61 to modulate the outside and return air dampers to produce the desired dewpoint condition to satisfy the requirements of the system.

Figure 6:
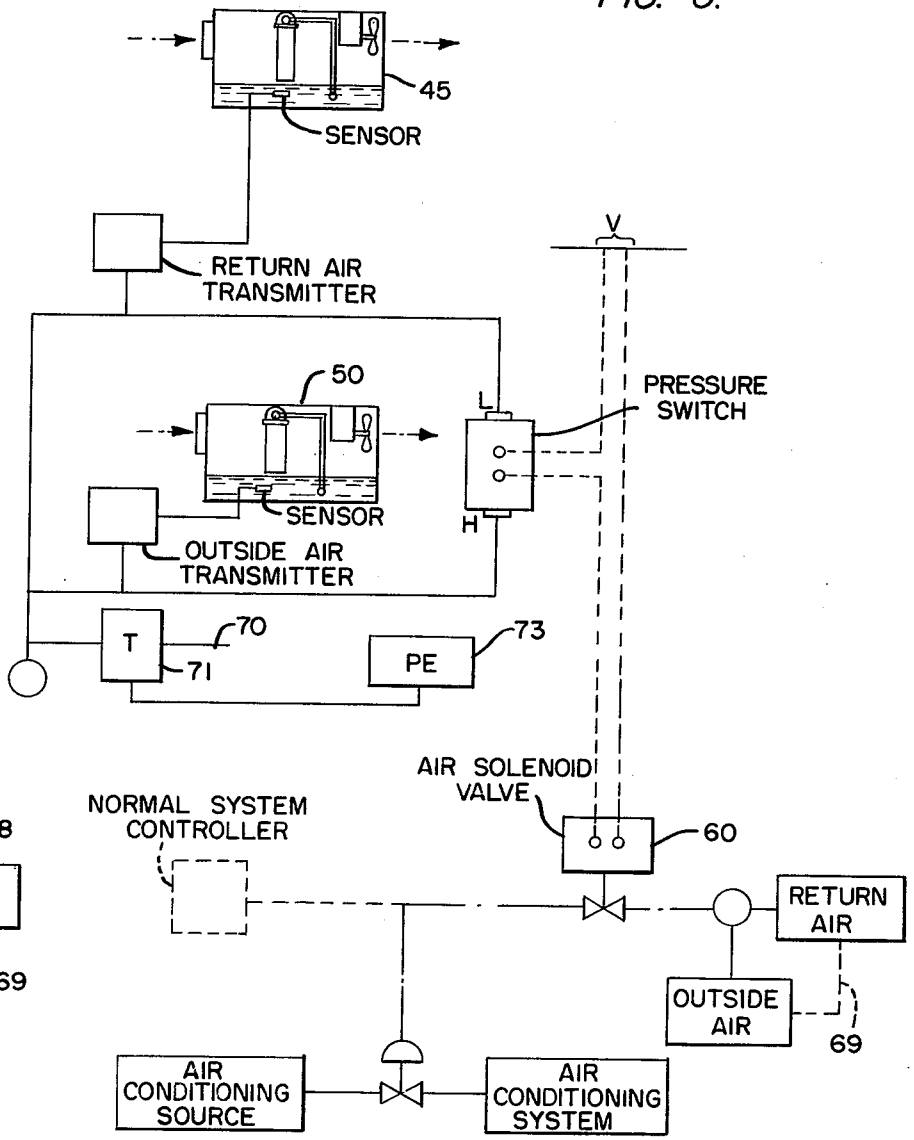
FIG. 6 is a block diagram of a control system similar to FIG. 5 showing a control system for a comfort air conditioning control system.

FIG. 6 is a block diagram of a control circuit similar to that shown in FIG. 5 for application to a non-washer system utilizing any of the commercially available cooling systems to cool air. The same reference numerals used to identify the elements in FIG. 5 have been used to identify like elements in FIG. 6. In FIG. 6, the PE element 62 is not used, but a direct acting outdoor air dry bulb sensor 70 and transmitter 71 is used in pneumatic circuit with the main air source 53 and a normally closed PE element 73. In this arrangement, when the outdoor wet bulb temperature becomes lower than the return air wet bulb temperature, the differential pressure switch 48 is activated, causing the system to convert to full outside air by operation of the dampers as previously described.

It should be noted that the source of cooling, shown as an air conditioning source in FIG. 6, could be any type of commercially available air conditioning including direct expansion coils, air coils cooled by the absorption principle, solar energy systems, and the like. In a conventional comfort system, an air washer is not generally used and the adiabatic saturation process is not available for full cooling.

This invention may be embodied in other specific forms without departing from its spirit or essential characteristics. The present embodiments are, therefore, to be considered in all respects as illustrative and not restictive, the scope of the invention being indicated by the claims rather than by the foregoing description, and all changes which come within the meaning and range of the equivalents of the claims are therefore intended to be embraced therein.

What is claimed is:

1. In combination, an apparatus for sensing the wet bulb temperature of sampled air passing therethrough ideally under adiabatic saturation conditions and providing a control signal representative of said wet bulb temperature comprising:

a housing which includes means for passing sampled air through said housing and sump means for collecting a body of water;

means cooperating with said housing for filtering said sampled air to remove physical contaminants from said sampled air;

mixing means for intimately mixing and contacting water from said sump means and said sampled air under conditions closely approximating adiabatic saturation;

means for recirculating said water, said recirculating means including a pump for pumping water from said sump means to said mixing means;

sensing means including a sensing element in said water in said sump means for sensing the temperature of said water when the temperature of said air and water are in equilibrium to provide an output representative of the wet bulb temperature of said sampled air;

transmitter means for transmitting a signal representing said wet bulb temperature; and floating means for maintaining the water level in said housing.

2. The combination as set forth in claim 1 wherein said mixing means includes water spray means in said housing adapted to disperse said water to contact intimately and mix with said sampled air passing through said housing.

3. The combination as set forth in claim 2 wherein said mixing means includes an air permeable member located within said housing to permit air to pass therethrough and to receive dispersed water from said spray means for mixing and contacting said air and said water.

4. The combination of claim 3 wherein said air permeable member includes an evaporative pad.

5. The combination of claim 1 wherein said recirculating means includes float means for maintaining the water level at a predetermined level in the sump means.

6. The combination of claim 1 further including control means for receiving said signal and controlling the operation of air damper means in response thereto.

7. The combination of claim 6 wherein said signal is representative of outside air enthalpy, said combination including means for comparing said outside air enthalpy with a second signal representing return air enthalpy and operating to open an outside air damper in response thereto when said outside air enthalpy is lower than return air enthalpy.

8. The combination of claim 7 wherein said signal and said second signal are pressure signals, said comparing means is a differential pressure switch, the operation of said pressure switch acting to control valve means in an air conditioning system to control the rate of cooling of said system in response to system controller.

9. In combination, a control apparatus for controlling both a cooling system which includes a cooling source, a cooling system, and controllable means coacting with said cooling source and said cooling system to control the rate of cooling thereof and an air damper system which includes an outside air damper, a return air damper, and damper control means including an air operated motor for controlling the operation of said dampers, said control apparatus including:

first sensing means for sensing the outside air enthalpy and providing a first pressure signal representative thereof;

second sensing means for sensing return air enthalpy and providing a second pressure signal representative thereof; and comparing means including a differential pressure switch for comparing said first pressure signal and said second pressure signal to cause said damper control means to operate to close at least partially said return air damper and open at least partially said outside air damper when said outside air enthalpy is lower than said return air enthalpy.

10. The combination of claim 9 wherein said comparing means causes said controllable means to reduce the rate of cooling of said cooling source and cooling system when said outside air enthalpy is lower than said return air enthalpy and a normal system controller is operative to require cooling.

11. The combination of claim 9 further including a normal system controller for controlling the operation of said controllable means.

12. The combination of claim 10 further including a normal system controller for controlling the operation of said controllable means.

13. The combination of claim 12 wherein said comparing means causes said controllable means to cease the cooling from said cooling source notwithstanding the state of operation of said normal system controller.

14. The combination of claim 9 wherein said comparing means causes said controllable means to reduce the rate of cooling of said cooling source and cooling system when said outside air enthalpy is lower than said return air enthalpy and the normal system controller is operative to require cooling, the operation of said controllable means occurring relative to a predetermined pressure differential.

15. The combination of claim 9 wherein at least one of said first and said second sensing means comprises:

a housing which includes means for passing sampled air through said housing and sump means for collecting a body of water;

means cooperating with said housing for filtering said sampled air to remove physical contaminants from said sampled air;

mixing means for intimately mixing and contacting water from said sump means and said sampled air under conditions approximating adiabatic saturation;

means for recirculating said water, said recirculating means including a pump for pumping water from said sump means to said mixing means;

sensing means including a sensing element in said housing for sensing the wet bulb temperature of said air when the temperature of said air and water are in equilibrium to provide an output signal representative of the wet bulb temperature of said sampled air; and transmitter means for transmitting a signal representing said wet bulb temperature.

16. The combination of claim 9 wherein both said first and second sensing means comprise:

a housing which includes means for passing sampled air through said housing and sump means for collecting a body of water;

means cooperating with said housing for filtering said sampled air to remove physical contaminants from said sampled air;

mixing means for intimately mixing and contacting water from said sump means and said sampled air under conditions approximating adiabatic saturation;

means for recirculating said water, said recirculating means including a pump for pumping water from said sump means to said mixing means;

sensing means including a sensing element in said housing for sensing the wet bulb temperature of said air when the temperature of said air and water are in equilibrium to provide an output signal representative of the wet bulb temperature of said sampled air; and transmitter means for transmitting a signal representing said wet bulb temperature.

17. In combination, a control apparatus for controlling both a cooling system which includes a cooling source, a cooling system and controllable means coacting with said cooling source and said cooling system to control the rate of cooling thereof and an air damper system which includes an outside air damper, a return air damper, and damper control means for controlling the operation of said dampers, said control apparatus including:

first sensing means for sensing the outside air enthalpy and providing a first signal representative thereof;

second sensing means for sensing return air enthalpy and providing a second signal representative thereof, at least one of said first and said second sensing means comprising:

a. a housing which includes means for passing sampled air through said housing and sump means for collecting a body of water, b. means cooperating with said housing for filtering said sampled air to remove physical contaminants from said sampled air, c. mixing means for intimately mixing and contacting water from said sump means and said sampled air under conditions closely approximating adiabatic saturation, d. means for recirculating said water, said recirculating means including a pump for pumping water from said sump means to said mixing means, e. sensing means including a sensing element in said water in said sump means for sensing the temperature of said water when the temperature of said air and water are in equilibrium to provide an output signal representative of the wet bulb temperature of said sampled air, and f. transmitter means for transmitting a signal representing said wet bulb temperature; and comparing means for comparing said first signal and said second signal to cause said damper control means to operate to close at least partially said return air damper and open at least partially said outside air damper when said outside air enthalpy is lower than said return air enthalpy.

18. The combination of claim 17, wherein both said first and said second sensing means comprise:

a housing which includes means for passing sampled air through said housing and sump means for collecting a body of water;

means cooperating with said housing for filtering said sampled air to remove physical contaminants from said sampled air;

mixing means for intimately mixing and contacting water from said sump means and said sampled air under conditions approximating adiabatic saturation;

means for recirculating said water, said recirculating means including a pump for pumping water from said sump means to said mixing means;

sensing means including a sensing element in said water in said sump means for sensing the temperature of said water when the temperature of said air and water are in equilibrium to provide an output signal representative of the wet bulb temperature of said sampled air; and transmitter means for transmitting a signal representing said wet bulb temperature.

* * * * *